US010107078B2

(12) United States Patent
Taylor et al.

(10) Patent No.: US 10,107,078 B2
(45) Date of Patent: Oct. 23, 2018

(54) CONNECTION AND DISCONNECTION OF HYDRAULIC EQUIPMENT IN HYPERBARIC ENVIRONMENTS

(71) Applicant: Subsea 7 Limited, Sutton (GB)

(72) Inventors: Robert Ian Taylor, Balmedie (GB); Graham Gibbons, Singapore (SG)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 15/035,948

(22) PCT Filed: Nov. 12, 2014

(86) PCT No.: PCT/GB2014/053354

§ 371 (c)(1),
(2) Date: May 11, 2016

(87) PCT Pub. No.: WO2015/071660

PCT Pub. Date: May 21, 2015

(65) Prior Publication Data

US 2016/0265313 A1 Sep. 15, 2016

(30) Foreign Application Priority Data

Nov. 12, 2013 (GB) ..... 1319956.7

(51) Int. Cl.

| | |
|---|---|
| ***E21B 41/00*** | (2006.01) |
| ***B63C 11/52*** | (2006.01) |
| ***E21B 41/04*** | (2006.01) |

(52) U.S. Cl.

CPC ..... *E21B 41/0007* (2013.01); *B63C 11/52* (2013.01); *E21B 41/04* (2013.01)

(58) Field of Classification Search

CPC ..... B63C 11/52; E21B 41/0007; E21B 41/04

(Continued)

(56) References Cited

U.S. PATENT DOCUMENTS

| | | | |
|---|---|---|---|
| 4,460,295 | A | 7/1984 | Migliarese-Caputi et al. |
| 5,143,483 | A | 9/1992 | Petersen |

(Continued)

FOREIGN PATENT DOCUMENTS

| | | |
|---|---|---|
| EP | 2 383 427 | 2/2011 |
| GB | 2 190 969 | 12/1987 |

(Continued)

*Primary Examiner* — Anna M Momper
*Assistant Examiner* — Patrick F Lambe
(74) *Attorney, Agent, or Firm* — Levy & Grandinetti

(57) ABSTRACT

A hydraulically-powered subsea tool system has a tool (26) and a tool power unit (12). The tool (26) communicates with a first connector element (30) on a hydraulic drive circuit (82). The tool power unit (12) has a hydraulic supply circuit (88) communicating with a second connector element (20). The connector elements are wet-mated with each other to connect the circuits for powering the tool. The circuits are pressure-compensated by respective compensators (136,90). When the circuits are connected, a valve (140) is operable to transfer pressure compensation of one of the circuits from the compensator (136) of that circuit to the compensator (90) of the other circuit. The valve (140) suitably transfers pressure compensation of the drive circuit from a drive circuit compensator to a supply circuit compensator.

21 Claims, 13 Drawing Sheets

(58) Field of Classification Search
USPC ..... 166/338
See application file for complete search history.

(56) References Cited

U.S. PATENT DOCUMENTS 5,988,281 A 11/1999 Douglas et al.
6,644,410 B1 * 11/2003 Lindsey-Curran .....
E21B 33/0355
166/338

FOREIGN PATENT DOCUMENTS

| | | |
|---|---|---|
| WO | WO 98/39548 | 9/1998 |
| WO | WO 03/097446 | 11/2003 |
| WO | WO 2006/100518 | 9/2006 |
| WO | WO 2008/129252 | 10/2008 |

* cited by examiner

CONNECTION AND DISCONNECTION OF HYDRAULIC EQUIPMENT IN HYPERBARIC ENVIRONMENTS

This invention relates to the use of hydraulic equipment underwater, particularly the problems of connection between, and disconnection of, items of such equipment in a hyperbaric environment during subsea intervention operations. The invention is particularly concerned with the problems of coupling together pressure-compensated hydraulic circuits under extreme hydrostatic pressure, as experienced at the great water depths often encountered in subsea oil and gas production.

The problems addressed by the invention arise from the requirement to deploy hydraulically-driven equipment underwater separately from the source of the hydraulic power that is necessary to drive that equipment. As an example, WO 03/097446 describes remotely-operable hydraulically-powered tool systems for underwater work vehicles. Such vehicles may be remotely-operated vehicles (ROVs) or autonomous underwater vehicles (AUVs).

WO 03/097446 describes how an underwater work vehicle such as an ROV may need different tools for different operations and so may be deployed with a set of interchangeable tools. Such tools may, for example, include torque tools and reciprocating tools driven by hydraulic motors or hydraulic actuators that run on pressurised hydraulic fluid supplied by the vehicle.

To avoid the need for the underwater work vehicle to make a lengthy trip to the surface whenever tools are to be interchanged, a set of tools is stored in a basket that is lowered to a suitable water depth so that the vehicle can fetch and couple the appropriate tool to itself as and when necessary.

The underwater work vehicle and the related tools have respective hydraulic circuits with self-sealing connector elements arranged for coupling underwater in a 'wet-mating' procedure. For example, WO 2012/138386 discloses a type of connector that is able to connect and disconnect underwater without leakage of hydraulic fluid. It is also important to prevent sea water entering the hydraulic circuits when their connector elements are uncoupled.

If the pressure difference between a closed hydraulic circuit and the surrounding water is too great, this may promote leaks at interfaces or damage elements of the hydraulic circuit, for example due to hoses bursting or collapsing. For this reason, pressure compensation is typically employed in deep-water applications to minimise pressure differences between hydraulic circuits and the surrounding water at any water depth. Examples of pressure-compensation systems are described in WO 2006/100518 and in WO 2008/129252.

When stored in a basket as in WO 03/097446, the tools remain connected to a pressure-compensated hydraulic circuit of the basket. This pre-pressurises each tool ready for use on being connected to a hydraulic pressure supply circuit of the underwater work vehicle, which is separately pressure-compensated.

Whilst the hydrostatic pressures experienced by the underwater work vehicle and the tools will be nominally the same when they are at the same depth, their separate pressure compensation systems may give rise to a variation in the fluid pressures within their respective hydraulic circuits. Consequently, the hydraulic pressure supply circuit of the underwater work vehicle contains pressurised fluid at a first pressure and the hydraulic circuits of the tools contain pressurised fluid at a second pressure that may differ slightly from the first pressure.

The fluid pressures in the hydraulic circuits of the underwater work vehicle and the chosen tool have to be nearly equal to perform connection. For connection to the hydraulic pressure supply circuit of the underwater work vehicle, the fluid pressure in the hydraulic circuit of the tool is brought to the ambient hydrostatic pressure. This approximates to the fluid pressure in the hydraulic supply circuit of the underwater work vehicle. Then, the connector element of the tool can be wet-mated onto the connector element of the hydraulic supply circuit of the underwater work vehicle. The differential in fluid pressure between the hydraulic circuits is assumed to be low enough for wet-mating to be easy with a low stroking force.

Various prior art documents describe approaches to reduce internal fluid pressure differences when connecting hydraulic circuits in air or in water. Generally, a discharge volume in the connector region is opened to reduce the higher pressure. However, none of these solutions can address the particular problems of deep water, where massive external hydrostatic pressure requires both hydraulic circuits being connected to be pressure-compensated.

A pressure-balanced stab connector in U.S. Pat. No. 5,988,281 aims to improve sealing under hydrostatic pressure. However, this type of connector is not self-sealing and it would require additional valves to isolate the circuit from seawater. Also, the connector is designed for fluid delivery when the operating pressure is significantly lower than hydrostatic pressure and so does not suit tool operation.

GB 2190969 discloses a hydraulic connector for subsea use but only one of the connected hydraulic circuits can be pressurised, unless a valve is provided on at least one side of the connector. Another approach disclosed in U.S. Pat. No. 4,460,295 is to use mechanical actuators to lock together the parts of the connector. However, that approach is too complex for the purposes of the present invention.

WO 98/39548 describes a subsea stab connector with a check valve that is automatically closed to avoid water ingress. As the fluid pressure inside the connector is initially much lower than the external pressure and increases once the connection is achieved, it would not work for the purposes of the present invention where the fluid pressure of both of the circuits to be connected is near hydrostatic pressure. In the stab connector of U.S. Pat. No. 4,863,314, the female hydraulic circuit must also have lower fluid pressure for the connection to be completed. Conversely, in U.S. Pat. No. 5,143,483, internal fluid pressure is used to seal the connector, which pressure must therefore be significantly higher than hydrostatic pressure.

It is against this background that the invention has been made.

From one aspect, the invention resides in a hydraulically-powered tool system for subsea interventions, the system comprising: a tool communicating with a first connector element, the tool and the first connector element being on a hydraulic drive circuit; and a tool power unit having a hydraulic supply circuit communicating with a second connector element. The first and second connector elements are arranged to be wet-mated with each other to establish fluid communication between the supply circuit and the drive circuit for powering the tool when in use. The drive circuit is pressure-compensated by a drive circuit compensator and the supply circuit is pressure-compensated by a supply circuit compensator.

In accordance with the invention, the system further comprises at least one valve that, when the drive circuit and the supply circuit are in fluid communication, is operable to transfer pressure compensation of one of said circuits from the compensator of that circuit to the compensator of the other circuit. The valve may, for example, be integral with the first connector element.

The tool power unit may, for example, be positioned in an underwater vehicle or in a power module such as a skid attached to an underwater vehicle. In that case, the tool is preferably arranged to be supported by the underwater vehicle in which the tool power unit is positioned or to which the power module is attached.

In the preferred embodiments to be described, the valve is operable to transfer pressure compensation of the drive circuit from the drive circuit compensator to the supply circuit compensator. In that case, the valve is preferably operable to isolate the drive circuit compensator from the drive circuit. For example, the valve may be disposed between the drive circuit compensator and the drive circuit so as, when open, to connect the drive circuit compensator to the drive circuit and, when closed, to isolate the drive circuit compensator from the drive circuit.

Elegantly, the valve may be operable to transfer pressure compensation of the drive circuit to the supply circuit compensator in response to increasing pressure in the supply circuit. For example, the valve may comprise a movable valve element disposed between the supply circuit and a valve seat, to be forced by overpressure in the supply circuit against the valve seat to close the valve.

The system of the invention may further comprise a pressure-relief valve communicating with the drive circuit compensator, in which case the valve that is operable to transfer pressure compensation may be disposed between the pressure-relief valve and the supply circuit.

A flexible hose may couple the tool to the first connector element; alternatively, the first connector element may be integrated with or rigidly attached to the tool.

The system of the invention may further comprise a locking system that is powered for locking the first and second connector elements in fluid communication and that is biased to unlock the first and second connector elements on loss of power.

The system of the invention may also comprise an ejection system that is powered to allow the first and second connector elements to be brought into fluid communication and that is biased to force apart the first and second connector elements on loss of power.

The inventive concept also embraces a corresponding method of pressure compensation when using a hydraulically-powered tool system for subsea interventions. The method of the invention comprises: wet-mating connector elements to establish fluid communication between a pressure-compensated hydraulic supply circuit and a pressure-compensated hydraulic drive circuit of a tool; and transferring pressure compensation of a first of said supply and drive circuits to a compensator acting on a second of said supply and drive circuits.

Similarly, the inventive concept extends to a connector element for a hydraulically-powered subsea tool system, wherein: the element communicates with a hydraulic drive or supply circuit that is pressure-compensated by a compensator; and the element comprises at least one first valve for opening and closing a fluid flow path through at least one port between the connector element and a hydraulically-powered subsea tool, and at least one second valve that is operable to transfer pressure compensation of the circuit from that compensator to a compensator of another circuit to which the connector is wet-mated in use.

In a combination of connector elements comprising at least one of the above-defined connector elements of the invention: a first connector element is on a hydraulic drive circuit; a second connector element is on a hydraulic supply circuit for supplying hydraulic fluid to the drive circuit when the connector elements are wet-mated in use; the drive circuit is pressure-compensated by a drive circuit compensator; the supply circuit is pressure-compensated by a supply circuit compensator; and the or each second valve is operable to transfer pressure compensation of one of said circuits from the compensator of that circuit to the compensator of the other circuit.

The inventive concept also covers a tool, a subsea vehicle or a power module for a subsea vehicle, comprising or communicating with a connector element of the invention or a combination of connector elements including at least one of the above-defined connector elements of the invention.

The invention allows hydraulic equipment to be pressure-compensated with its own compensator system during its movement through the water column, when deployed separately from an underwater work vehicle such as an ROV. The on-board pressure compensation of the hydraulic equipment ensures that hydraulic service lines of the equipment are suitably pressure-compensated as the equipment travels up and down through the water column when stowed in a deployment basket, for example.

Upon connecting the hydraulic equipment to the hydraulic power supply of an underwater work vehicle at depth, the invention switches the pressure compensation method to use a pressure compensator system of the vehicle instead. To this end, the invention integrates a valve for switching pressure compensation of hydraulic service lines between a pressure compensator of the hydraulic equipment and a pressure compensator of the vehicle. Connection suitably involves wet-mating a multi-way hydraulic connector that communicates with the hydraulic equipment with a multi-way hydraulic connector mounted on the vehicle. The connector associated with the hydraulic equipment may, for example, communicate with the hydraulic equipment via a flexible hose although that connector could instead be mounted directly or rigidly to the hydraulic equipment.

Optionally, the invention features an emergency disconnection mechanism to disconnect the multi-way hydraulic connectors. To facilitate recovery of the underwater work vehicle in an emergency, the invention also contemplates an optional emergency eject feature to allow complete disposal from the vehicle of the connector associated with the hydraulic equipment. This is an optional add-on system that can be removed where operational judgement so allows.

Consequently, preferred embodiments of the invention have the capability to allow all service lines of hydraulically-driven equipment to be pressure-compensated during transit through the water column. They add the capability to isolate the compensation system of the hydraulically-driven equipment when that equipment is being supplied with hydraulic power through a wet-mated connector. They also have the capability to disconnect the wet-mated connection automatically in failure scenarios.

In summary, therefore, the invention provides a hydraulically-powered subsea tool system comprising a tool and a tool power unit. The tool communicates with a first connector element on a hydraulic drive circuit. The tool power unit has a hydraulic supply circuit communicating with a second connector element. The connector elements are wet-mated with each other to connect the circuits for powering the tool. The circuits are pressure-compensated by respective compensators.

When the circuits are connected, a valve is operable to transfer pressure compensation of one of the circuits from the compensator of that circuit to the compensator of the other circuit. The valve suitably transfers pressure compensation of the drive circuit from a drive circuit compensator to a supply circuit compensator.

In order that the invention may be more readily understood, reference will now be made, by way of example, to the accompanying drawings, in which.

Figure 1:
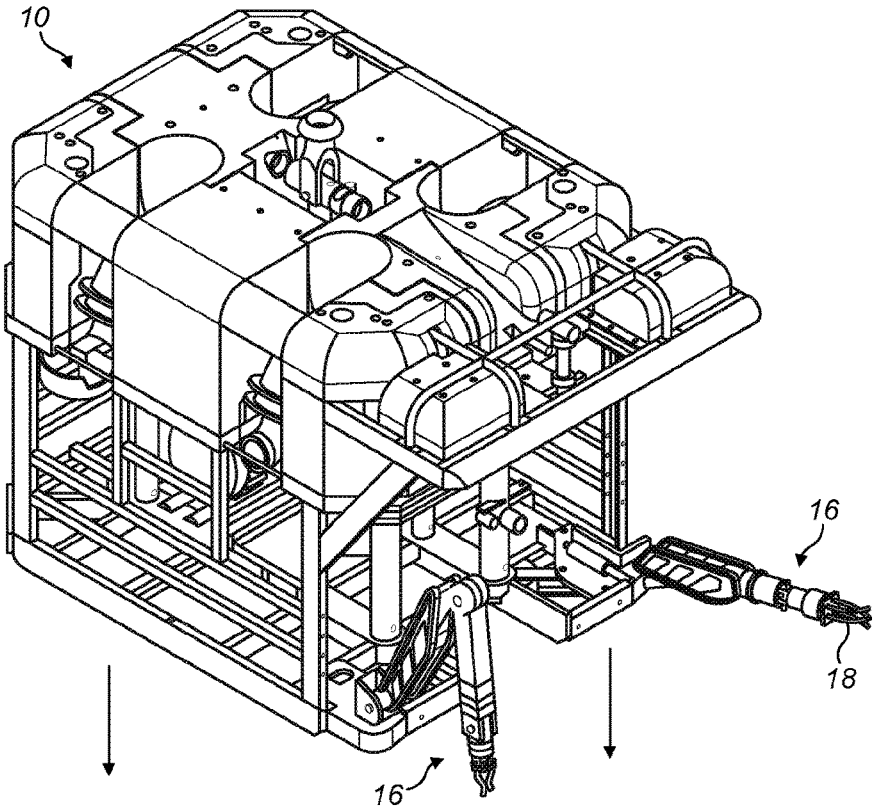
FIG. 1 is a perspective view of an ROV as an example of an underwater work vehicle.
Figure 2:
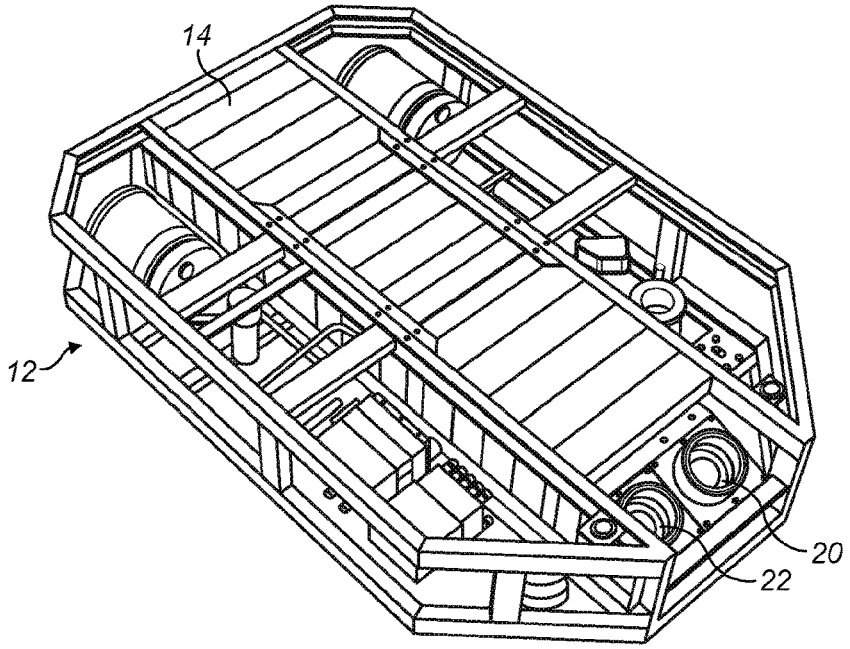
FIG. 2 is a perspective view of a tooling skid for attachment to an underside of the ROV of FIG. 1, the skid having a connector element in accordance with the invention.

FIGS. 1 and 2 show, respectively, a work-class ROV 10 and a tooling skid 12 that can be docked to the underside of the ROV 10 via suitable mechanical, electrical and hydraulic interfaces between the ROV 10 and the skid 12 in a well-known manner. To avoid adversely affecting the buoyancy, trim and handling characteristics of the ROV 10, the skid 12 carries various buoyancy blocks 14 to achieve neutral buoyancy.

As is typical, the ROV 10 has manipulator arms 16 to perform subsea intervention, for example by holding and manipulating various hydraulically-driven tools. Such tools usually have a handle that is shaped to be held by a grab 18 on a manipulator arm 16. For example, a fishtail-shaped handle is convenient to use with a common three-finger jaw grab, although other arrangements are possible.

The skid 12 carries a hydraulic power unit and a reservoir system with associated fluid circuits under the control of a control system, which adapts the ROV 10 to provide hydraulic power and other fluids to tools carried by the ROV 10. For this purpose, fluid circuits of the skid 12 must be connected to fluid circuits of a tool via a multi-way connector of the invention.

The connector comprises a female connector element, or socket 20, positioned at a front end of the skid 12 to be readily accessible by the manipulator arms 16 of the ROV 10. A protection cap (not shown) is inserted into the socket 20 to prevent debris or sea creatures entering the socket 20 as the ROV 10 dives to depth. Before selecting a tool to use, a manipulator arm 16 of the ROV 10 pulls the cap out of the socket 20 and stores the cap in a holster 22 beside the socket 20.

Figure 3:
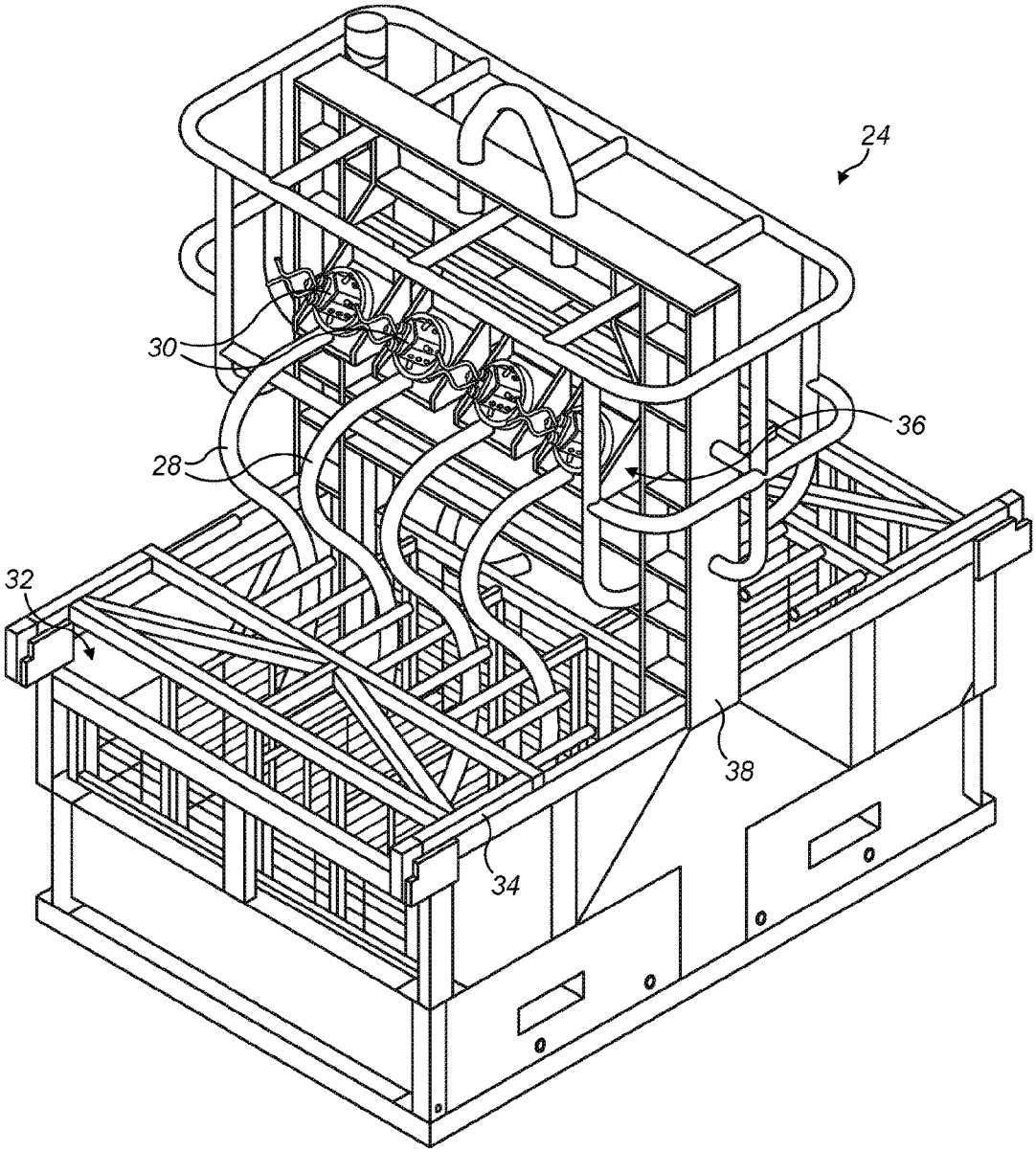
FIG. 3 is a perspective view of a tooling deployment basket for carrying a set of ROV tools through the water column to and from a subsea work site, each tool in the basket having another, complementary connector element in accordance with the invention.
Figure 4:
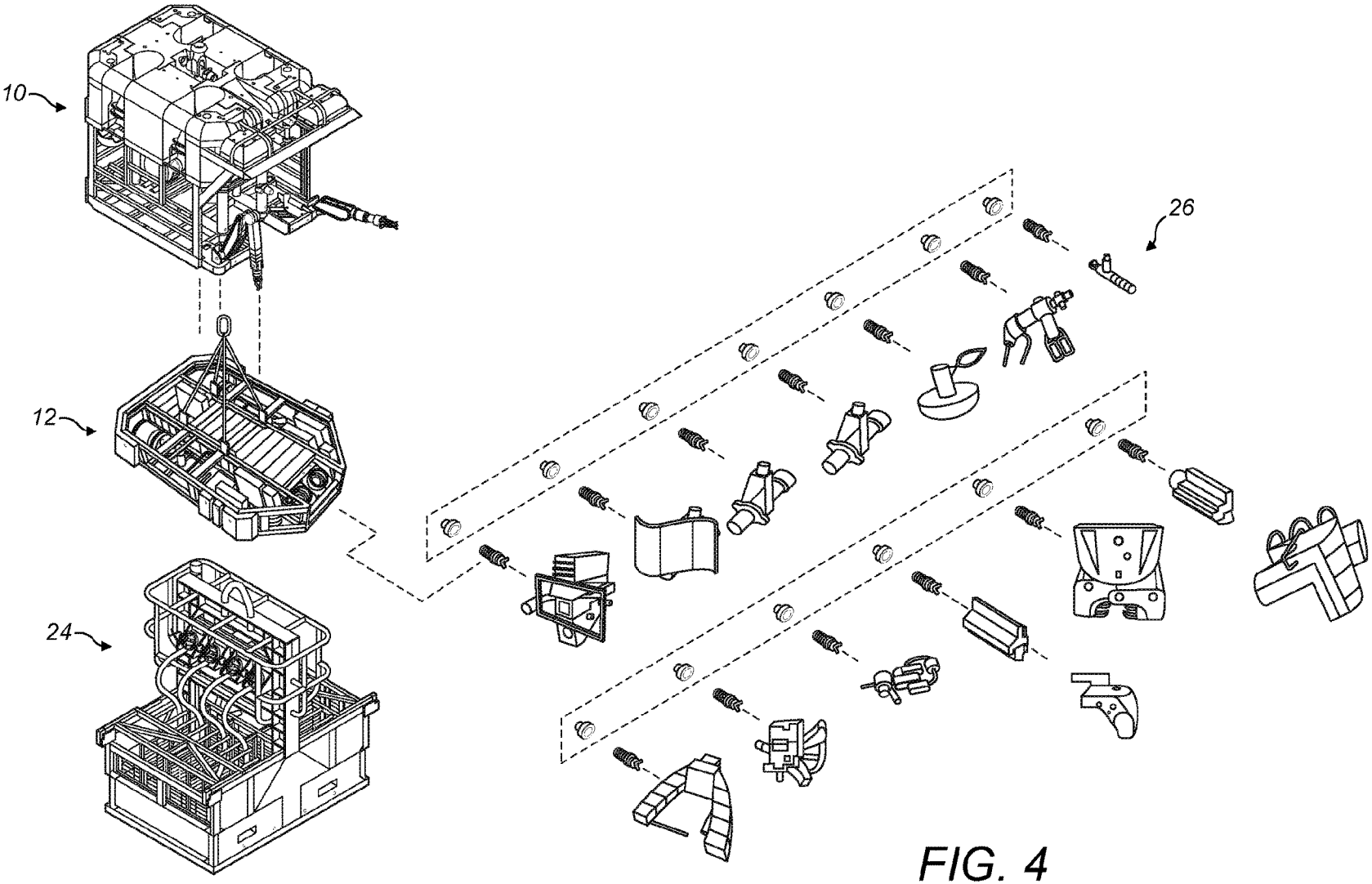
FIG. 4 is a perspective view showing the ROV, skid and basket of FIGS. 1 to 3 and a suite of possible ROV tools each having a respective connector element that can be coupled selectively with the connector element on the skid docked with the ROV.

FIG. 3 shows a tooling deployment basket 24 that can be suspended at a suitable depth or, more usually, landed on the seabed adjacent to a subsea work site. The basket 24 carries a set of hydraulically-driven tools selected from a suite of tools 26 exemplified in FIG. 4. The tools 26 are joined by respective flexible hoses 28 to respective male connector elements, or plugs 30, that are complementary to the socket 20 carried by the skid 12. Pressure compensation is provided individually for each fluid circuit of each tool 26 by pressure compensating systems in the plugs 30 associated with the tools 26.

Whilst the tools 26 in the basket 24 are obscured in the view of FIG. 3, a row of plugs 30 and their respective hoses 28 are visible in that figure. The hoses 28 extend outwardly and downwardly from the plugs 30 into a stowage bay 32 of the basket 24 where the associated tools 26 are held. A cover 34 over the stowage bay 32 retains the tools 26 in the stowage bay 32 until the ROV 10 hinges the cover 34 away to gain access to a chosen tool 26.

The plugs 30 of the tools 26 are held in respective receptacles 36 that are arranged in a row on an elevated central support structure 38 of the basket 24, in positions accessible to the manipulator arm 16 of an ROV 10. A similar row of plugs 30 may be held in receptacles 36 on the other side of the central support structure 38, hidden in FIG. 3. When so held, fishtail handles on the plugs 30 project outwardly from the central support structure 38 to be easily accessible for the ROV 10 to grab.

The construction of, and interaction between, the plug 30 and the socket 20 will be described later in detail with reference to FIGS. 11 to 15 of the drawings. Meanwhile turning to FIGS. 5 to 10, this series of figures shows the ROV 10 docked with the skid 12 and in use underwater, interacting with the basket 24 and with a tool 26 carried by the basket 24.

Figure 5:
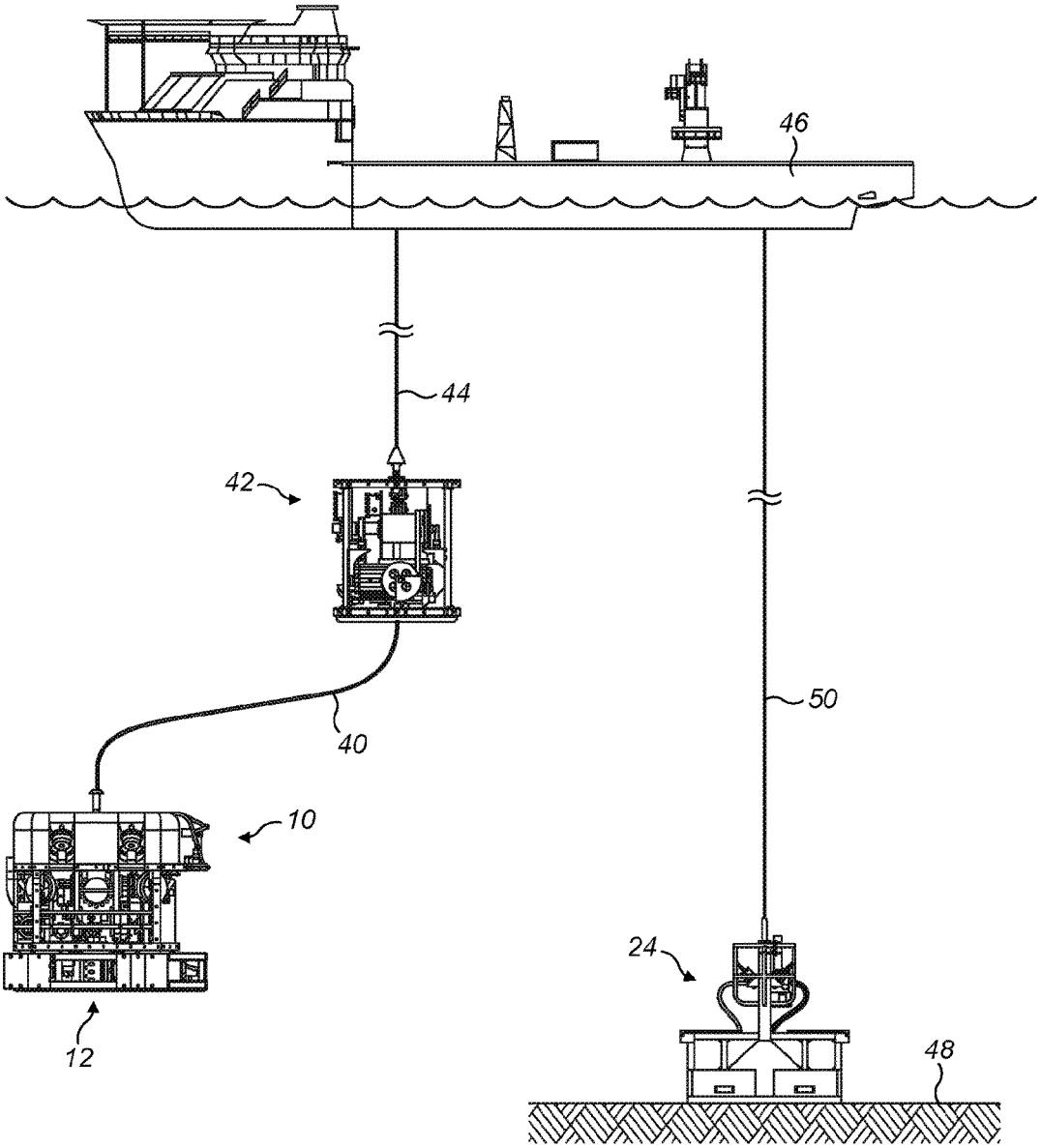
FIGS. 5 to 10 are a series of side views of the ROV of FIG. 1 docked with the skid of FIG. 2, in use underwater to interact with ROV tools carried by the basket of FIG. 3.

FIG. 5 shows the ROV 10 attached conventionally by a tether cable 40 to a tether management system 42 that is suspended in turn by an armoured umbilical 44 hanging from a winch (not shown) on a surface support vessel 46. The vessel 46 is also shown in FIG. 5 having lowered the basket 24 to the seabed 48, the basket 24 being suspended from the vessel 46 at this point by a winch wire 50. The winch wire 50 may be disconnected from the basket 24 after the basket 24 has been placed on the seabed 48, as is shown in FIGS. 6 to 10.

Figure 6:
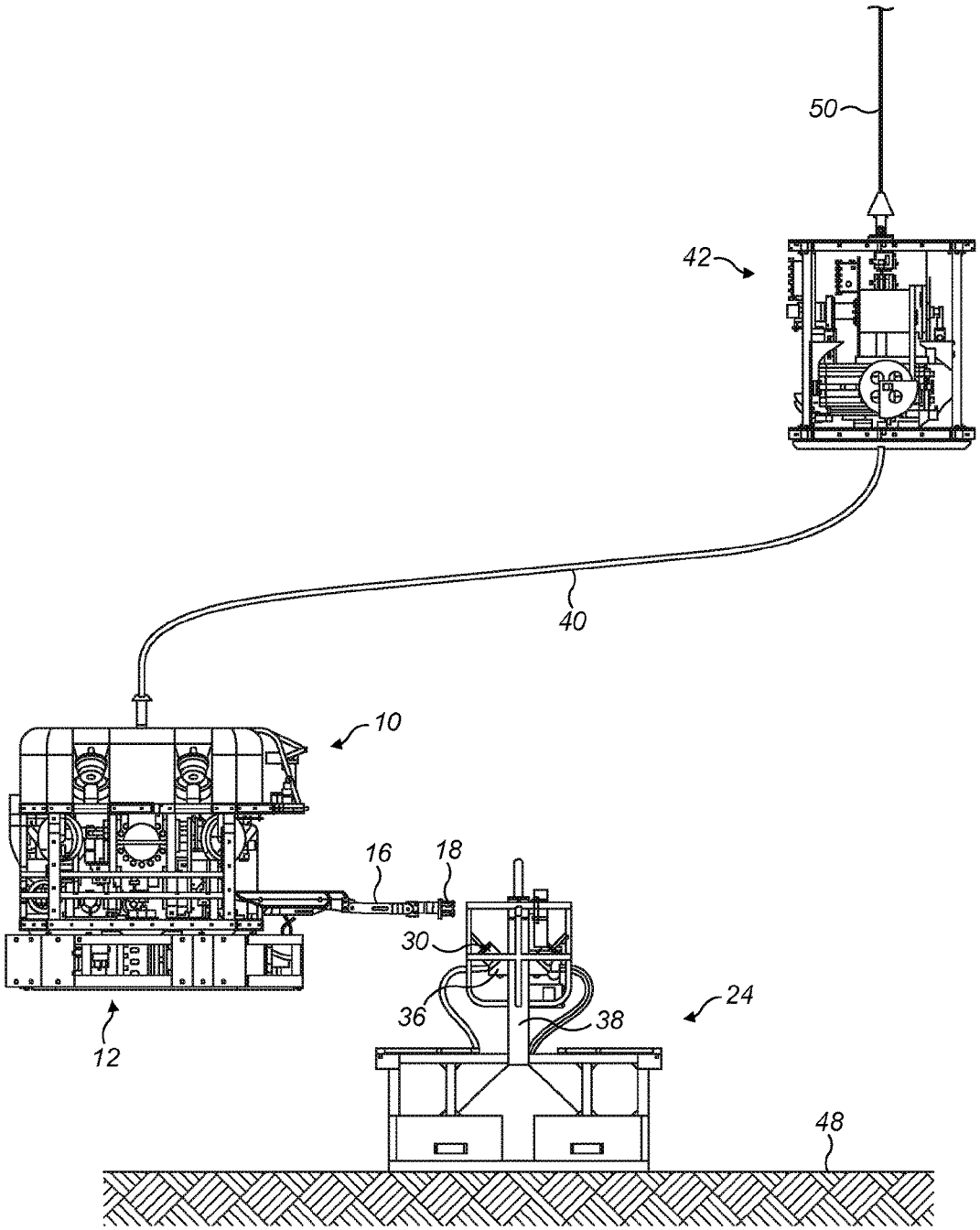

FIG. 6 shows the ROV 10 having been flown to the basket 24 to select a desired tool 26 from a set of tools 26 carried by the basket 24. A manipulator arm 16 of the ROV 10 is shown extended toward the handle of an appropriate one of the plugs 30 held by the central support structure 38 of the basket 24. Once a grab 18 on the manipulator arm 16 engages with the handle of the plug 30, the manipulator arm 16 lifts the plug 30 from its receptacle 36 on the central support structure 38 and inserts the plug 30 into the socket 20 on the skid 12.

Figure 7:
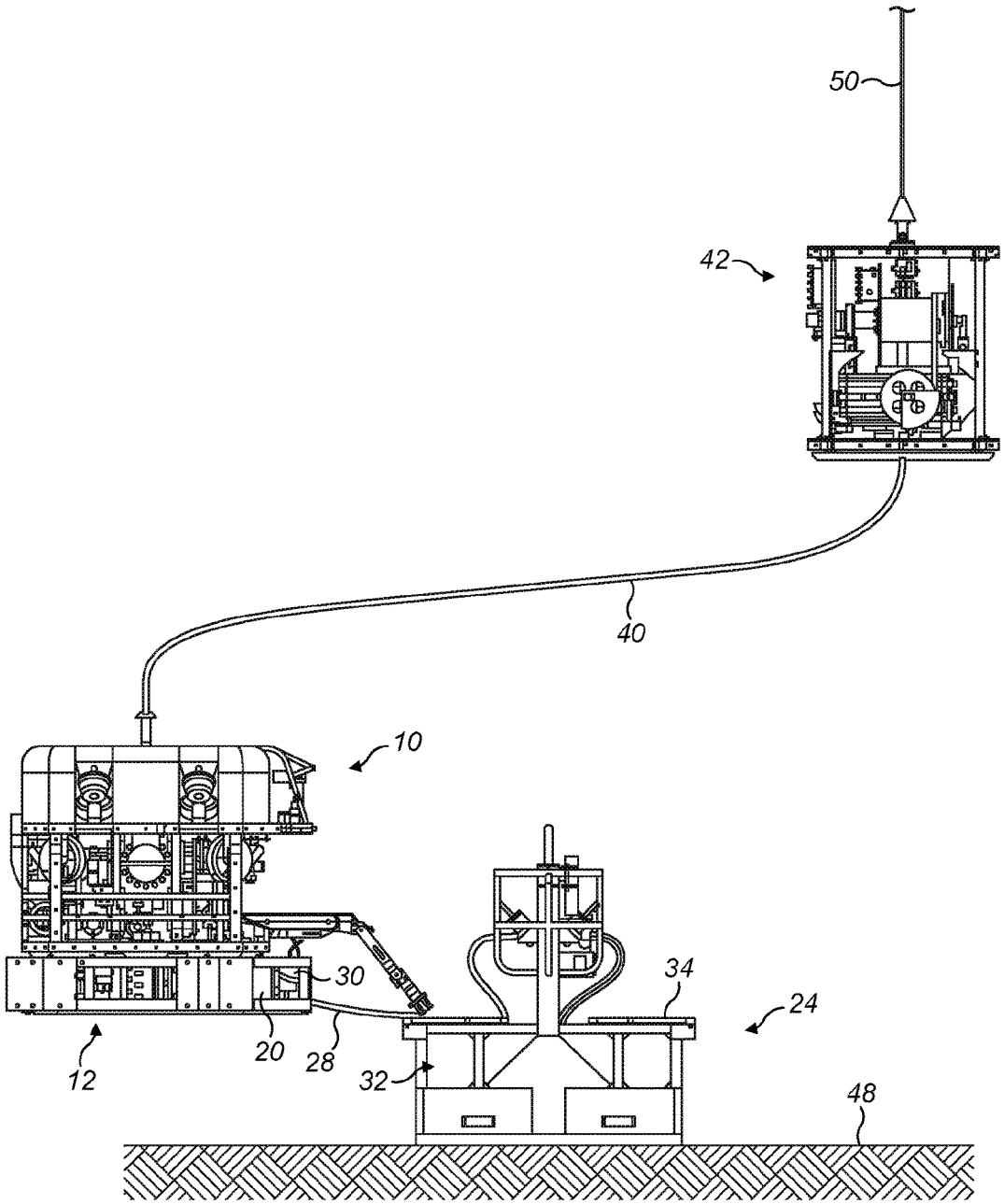

FIG. 7 shows the plug 30 inserted into the socket 20 with the hose 28 trailing back from the plug 30 to a tool 26 that, at this point, remains hidden in the stowage bay 32 of the basket 24. When the plug 30 has been inserted into the socket 20 in this way, fluid circuits of the skid 12 are connected to fluid circuits of the associated tool 26 via aligned hydraulic service ports in the plug 30 and the socket 20. This multi-way connection allows a high flow capability, a nominal example being up to 100 L/min flow at a pressure of 210 bar above ambient.

Figure 8:
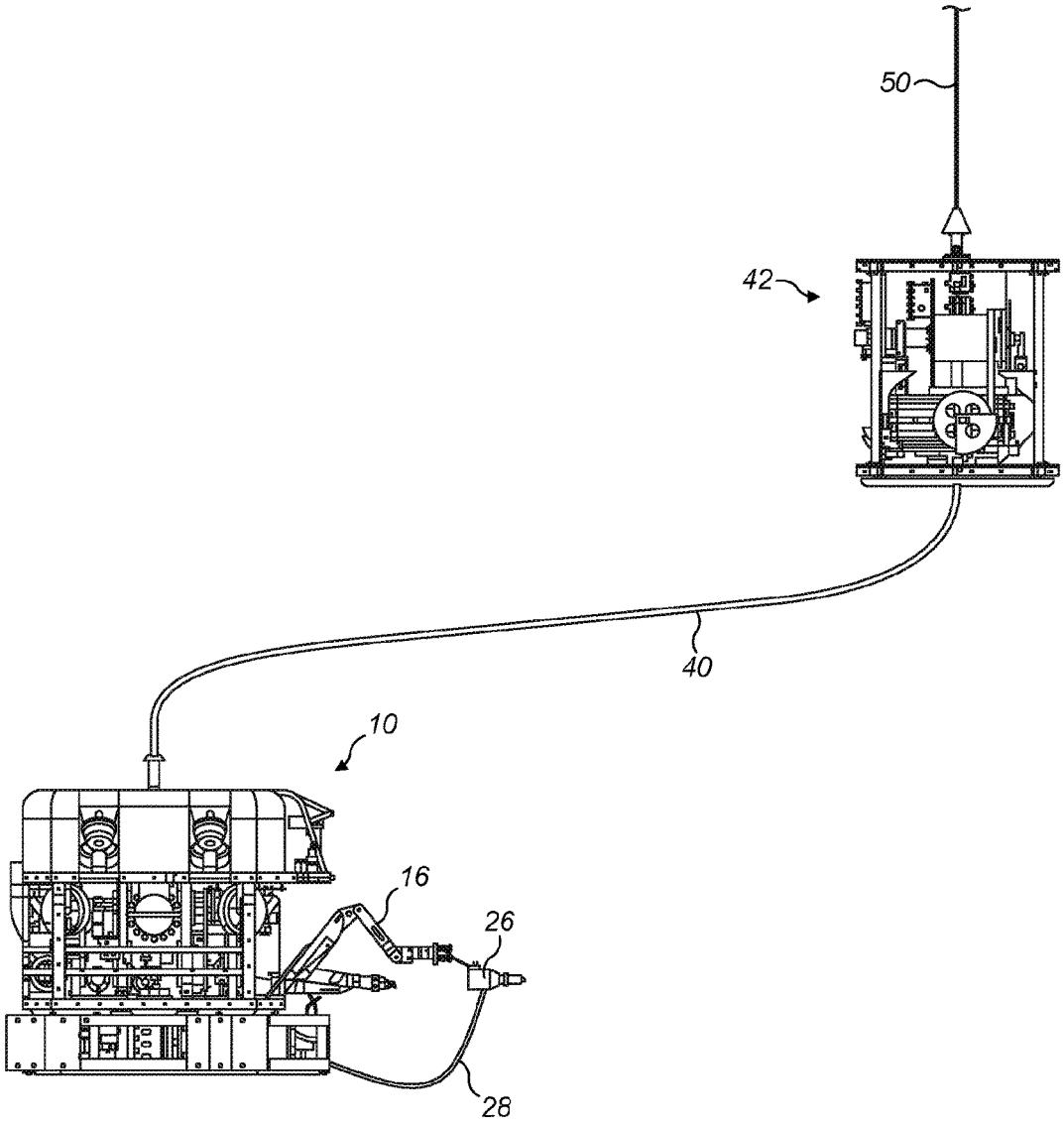
Figure 9:
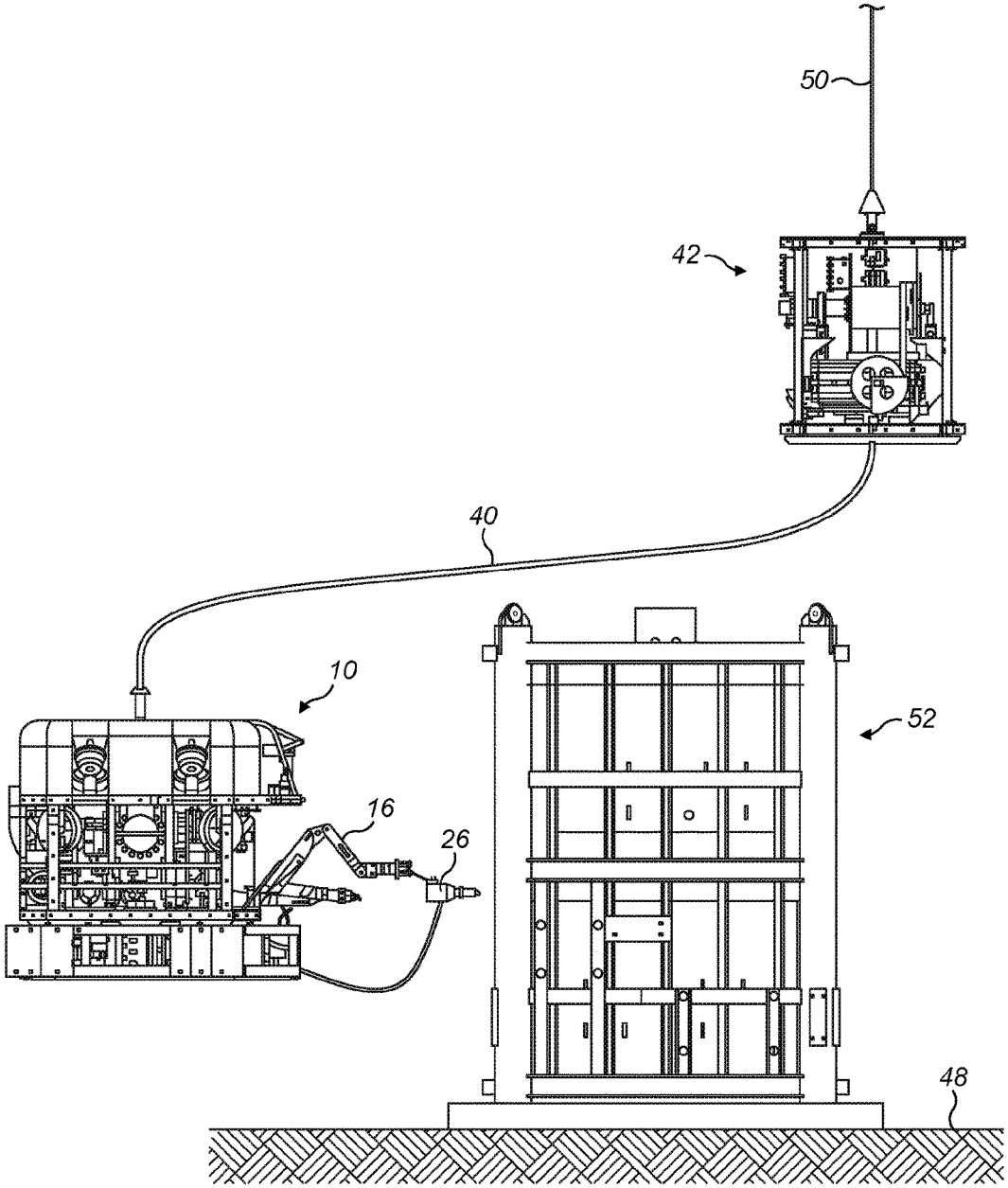

Next, after lifting the appropriate cover 34 of the basket 24 to gain access to the tools 26 in the stowage bay 32, the manipulator arm 16 of the ROV 10 lifts the chosen tool 26 from the basket 24 via a handle on the tool 26 as shown in FIG. 8. The ROV 10 is then flown off to perform a task on an item of subsea equipment 52 using the tool 26, as shown in FIG. 9.

Figure 10:
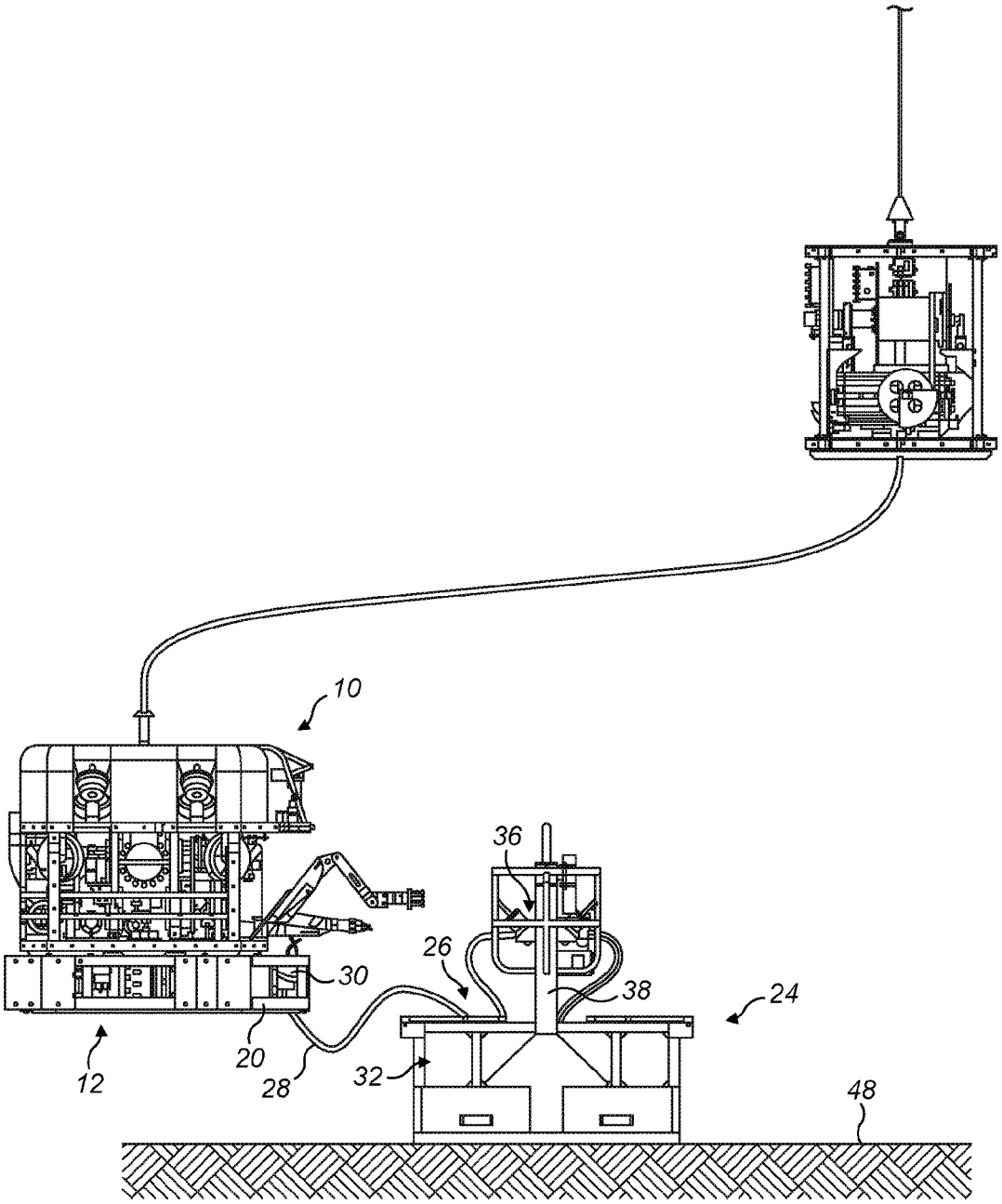

Once the required task has been performed on the subsea equipment 52, the ROV 10 is flown back to the basket 24 to return the tool 26 to the stowage bay 32 as shown in FIG. 10. At this point, the plug 30 associated with the tool 26 remains coupled to the socket 20 of the skid 12 but the manipulator arm 16 of the ROV 10 is about to pull the plug 30 out of the socket 20 and return it to the appropriate receptacle 36 on the central support structure 38 of the basket 24. When the plug 30 is uncoupled from the socket 20, valves at the interface between the hydraulic service ports in the plug 30 and the socket 20 prevent leakage of hydraulic fluid out of, and sea water into, the hydraulic service lines.

Figure 11:
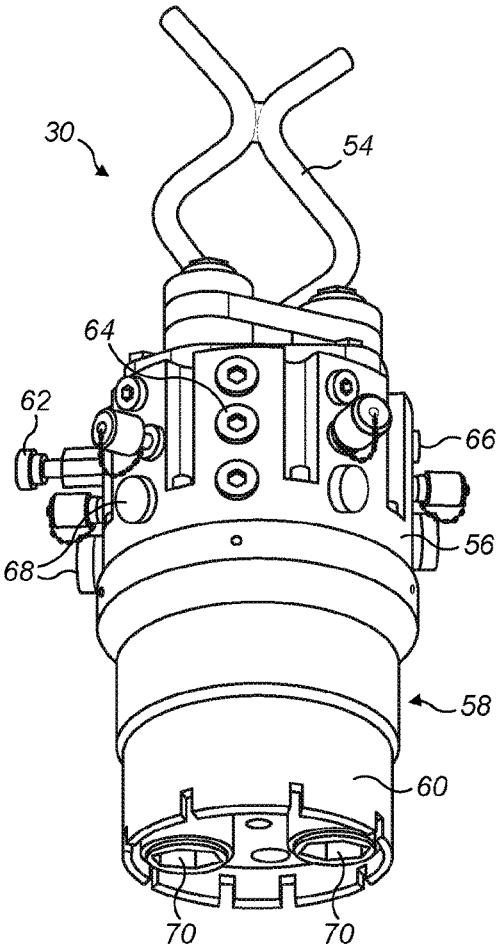
FIGS. 11 and 12 are perspective views of, respectively, a plug and a socket being examples of the complementary connector elements for connecting hydraulic circuits of an ROV tool and the ROV/skid assembly seen in FIGS. 5 to 10.
Figure 12:
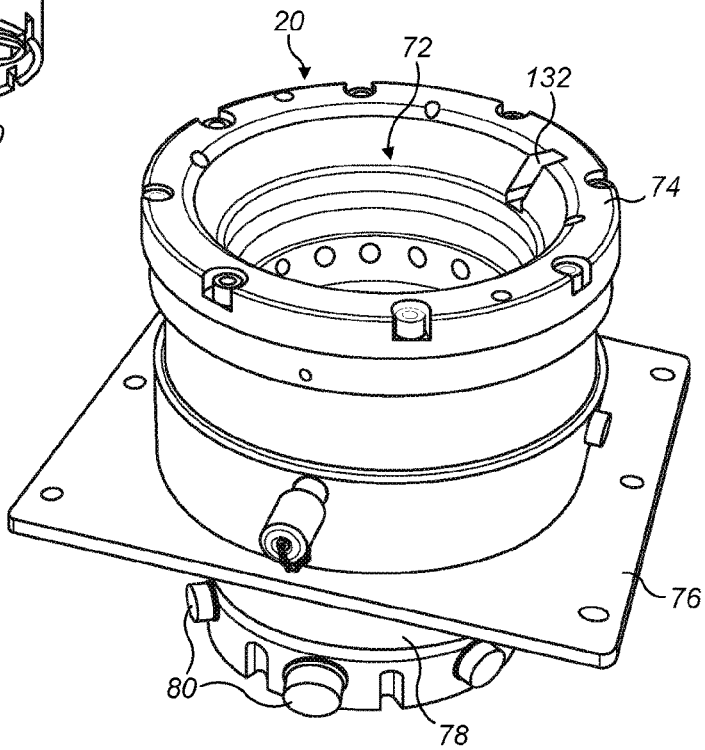
Figure 13:
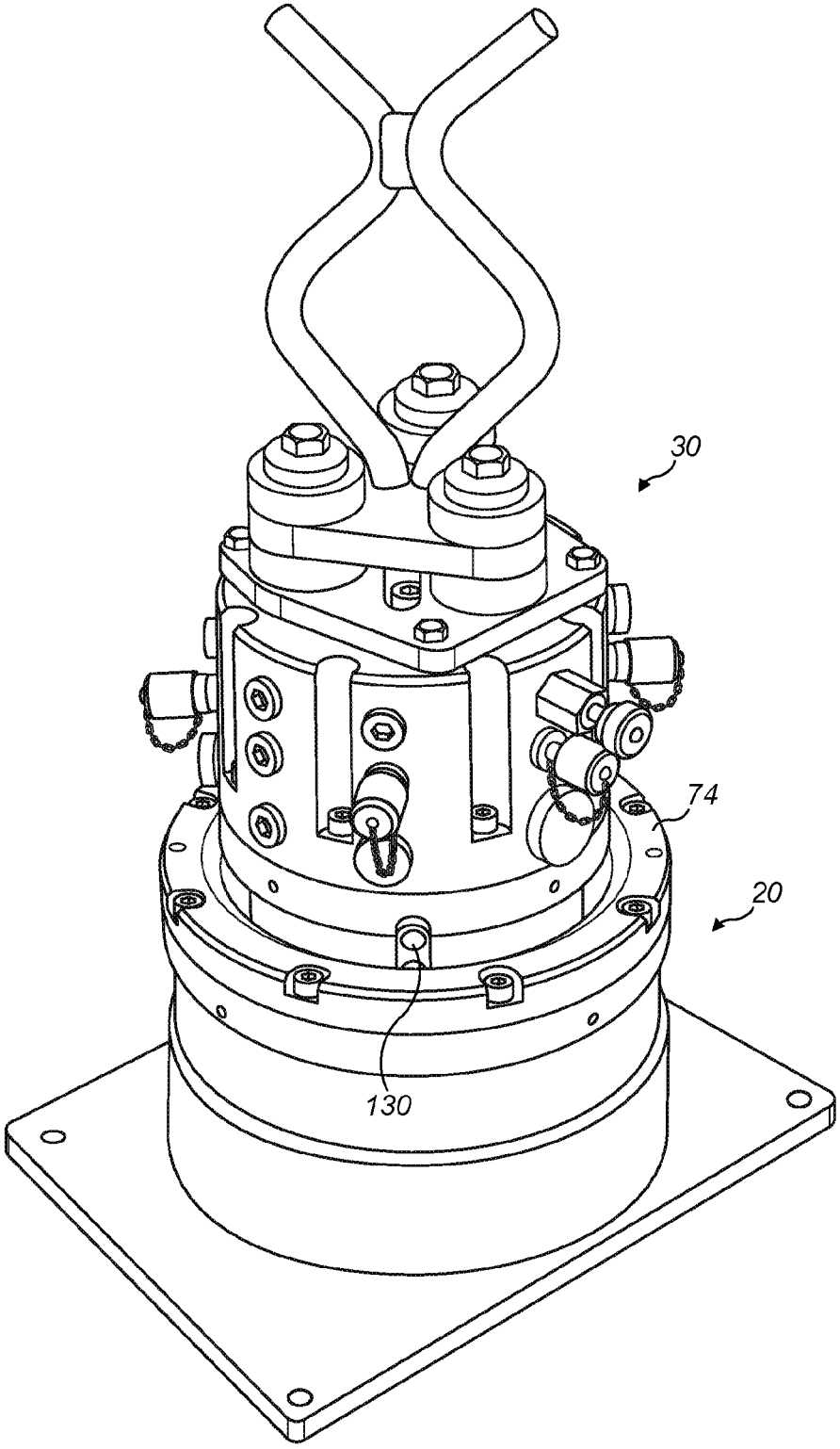
FIG. 13 is a perspective view of the plug and socket of FIGS. 11 and 12 engaged with each other.
Figure 14:
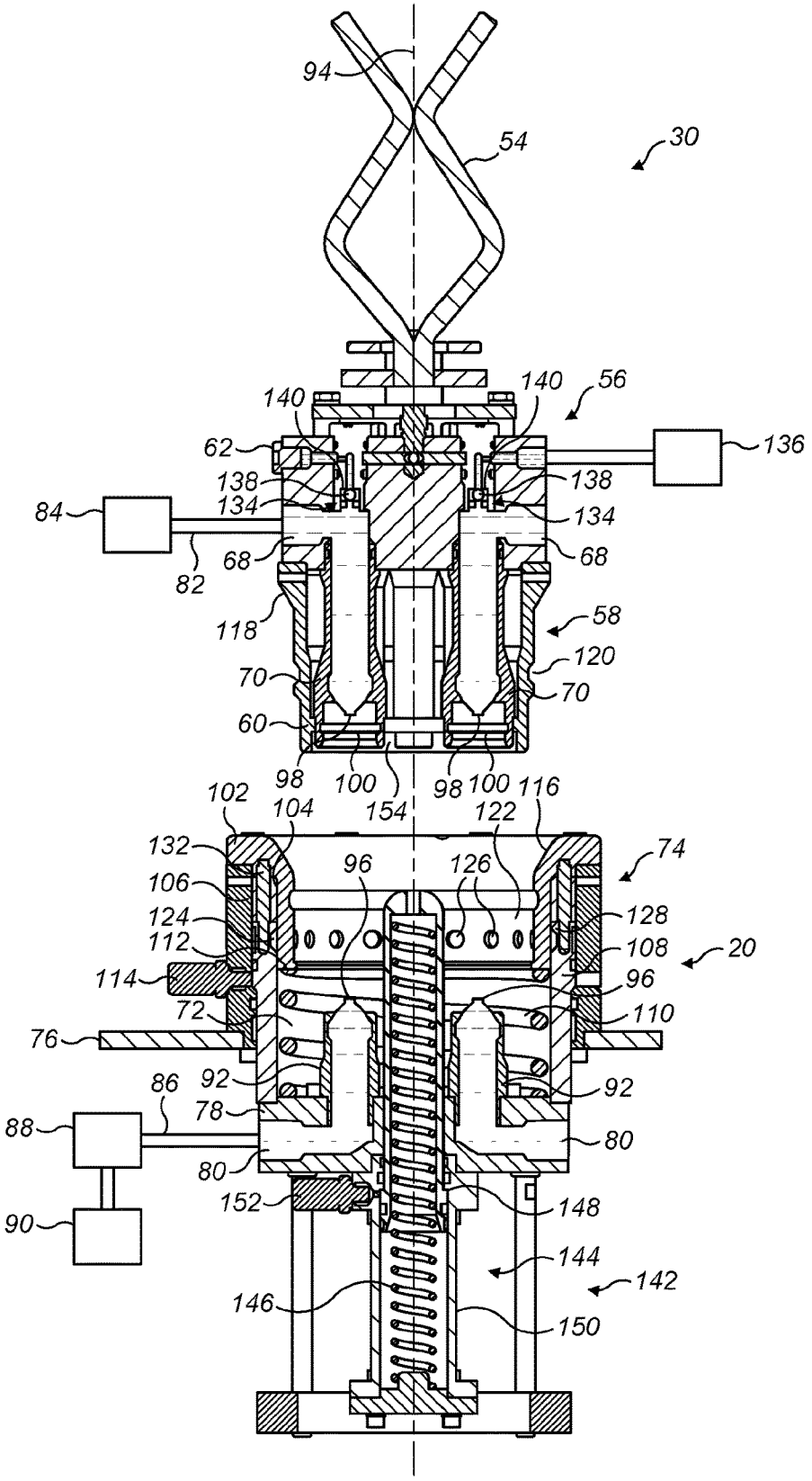
FIGS. 14 and 15 are enlarged sectional side views of the plug and socket shown in FIGS. 11 to 13, showing the plug and socket decoupled from and coupled to one another, respectively.
Figure 15:
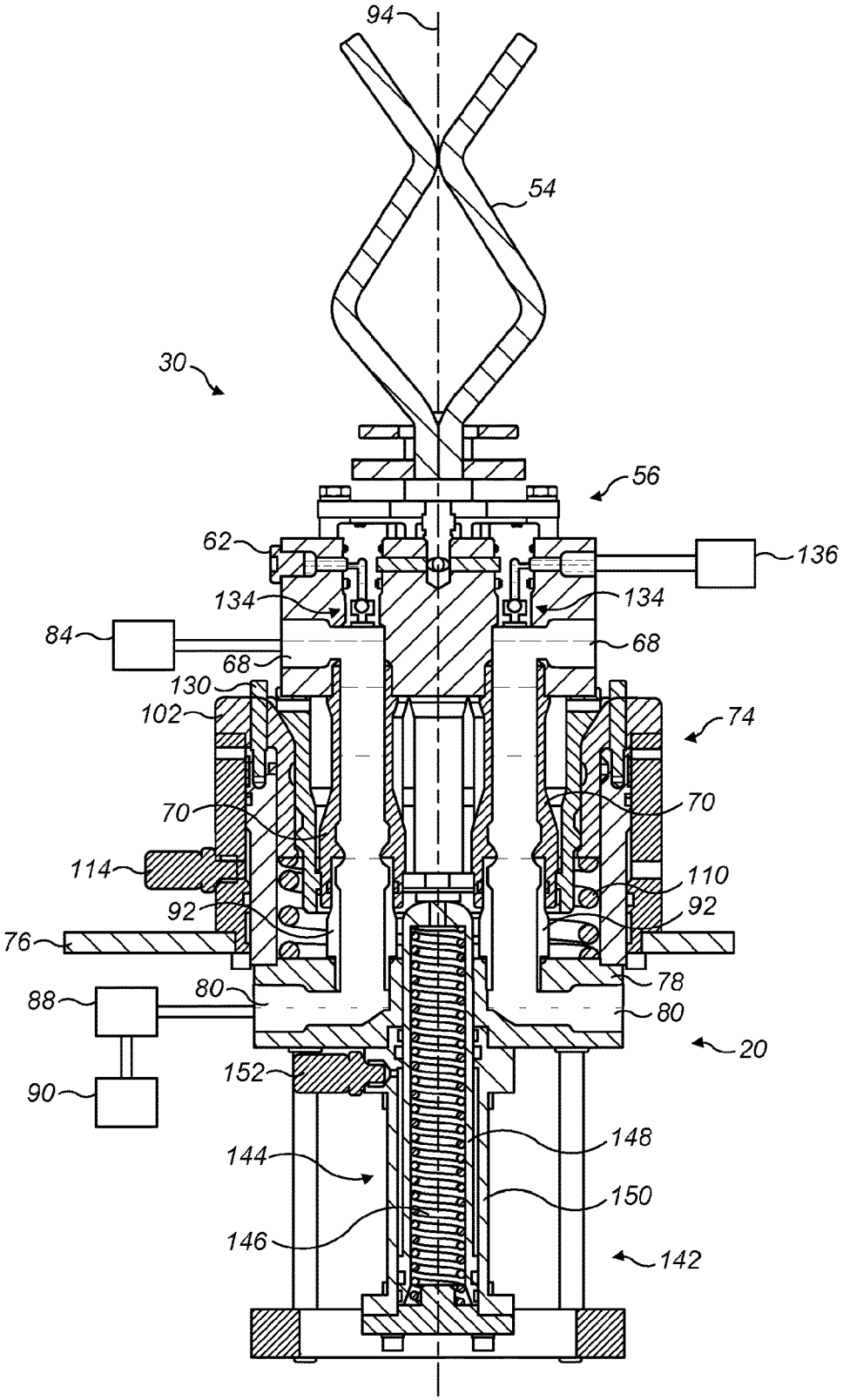

FIGS. 11 to 15 of the drawings show a socket 20 and a plug 30 in more detail and help to explain their interaction. FIGS. 11 to 13 show the socket 20 and the plug 30 in general terms and FIGS. 14 and 15 show the internal features of the socket 20 and the plug 30 in detail.

FIG. 11 shows that the plug 30 comprises, from top to bottom as pictured:

- a handle 54 to be grasped by the manipulator arm 16 of the ROV 10, the handle 54 in this example being of fishtail shape;
- a plug body 56 to which the handle 54 is attached, the plug body 56 supporting internal and external ports and containing fluid flow paths communicating with and between the internal and external ports; and
- a male projection 58 comprising a tubular skirt 60 that extends from the body.

Features visible on the outside of the plug body 56 are a safety pressure relief valve 62, connector manifold ports 64, a compensator gallery port 66 and various service ports 68 for service lines. Also, the skirt 60 of the male projection 58 surrounds hydraulic couplers in the form of hollow connector pins 70, which will be described below with reference to FIGS. 14 and 15.

FIG. 12 shows that the socket 20 comprises, from top to bottom as pictured:

- a female cavity 72 defined by a tubular housing 74 to receive the projecting tubular skirt 60 of the plug 30;
- a mounting plate 76 by which the socket 20 is attached to the skid 12; and
- a socket body 78 that, like the plug body 56, supports internal and external ports and contains fluid flow paths communicating with and between the internal and external ports. The socket body 78 supports various service ports 80 for service lines and conceals a receptacle 36 or socket manifold within.

FIG. 13 shows how the tubular housing 74 that defines the female cavity 72 of the socket 20 receives the projecting tubular skirt 60 that defines the male projection 58 of the plug 30. Insertion of the skirt 60 into the cavity 72 takes place in an insertion direction that is parallel to a central longitudinal axis shared by the body and skirt 60 of the plug 30 and the body and housing 74 of the socket 20.

Turning finally to FIGS. 14 and 15, among the various internal features of the plug 30 and socket 20, these show how fluid flow paths of the plug 30 and socket 20 communicate with external and internal ports.

The external service ports 68 of the plug 30 connect through hydraulic service lines 82 to a tool drive 84 such as a hydraulic motor of a torque tool or a linear actuator, by way of example. The external service ports 80 of the socket 20 connect through hydraulic service lines 86 to a fluid circuit 88 of the skid 12, those circuits typically including a hydraulic power unit and a reservoir system. The fluid circuit 88 of the skid 12 is pressure-compensated by a vehicle pressure compensator 90.

The internal ports of the plug 30 and socket 20 are defined by respective tubular connector pins that engage with opposed counterparts when the plug 30 is inserted into the socket 20. The connector pins and their counterparts form co-operable pairs, each pair being associated with a respective fluid circuit 88 of the skid 12 and the tool 26 once coupled to each other.

Specifically, tubular female connector pins 70 extend from the plug body 56 within the skirt 60 of the plug 30, such that the skirt 60 encircles the female connector pins 70. In opposition to and angular alignment with the female connector pins 70, tubular male connector pins 92 extend from the socket body 78 into the female cavity 72 of the socket 20, such that the housing 74 of the socket 20 encircles the male connector pins 92. The female and male connector pins 70, 92 are angularly or circumferentially spaced about the central longitudinal axis 94 and all of them extend parallel to that axis 94 and hence to the insertion direction.

Each male connector pin 92 comprises a relatively wide root and a relatively narrow tip. A needle valve 96 protruding from within the male connector pin 92 is biased outwardly or distally to close a distal end opening of the hollow tip. Conversely, each female connector pin 70 comprises a relatively wide mouth and a relatively narrow throat. Another needle valve 98 protruding from within the hollow female connector pin 70 is biased outwardly or distally to close the throat.

The root of the male connector pin 92 is a sliding fit in the mouth of the female connector pin 70 and the tip of the male connector pin 92 is a sliding fit in the throat of the female connector pin 70. So, when the plug 30 and socket 20 are brought together for wet-mating as shown in FIGS. 13 and 15, the tip and the root of each male connector pin 92 are received, respectively, within the throat and the mouth of the opposed female connector pin 70. A circumferential seal 100 within the mouth of the female connector pin 70 then seals around and against the root of the male connector pin 92.

Meanwhile, the distally-biased needle valve 96 protruding from the hollow male connector pin 92 bears against the distally-biased needle valve 98 protruding from the hollow female connector pin 70. This pushes the needle valve 98 of the female connector pin 70 inwardly or proximally to open the throat, which admits the tip of the male connector pin 92. The needle valve 96 of the male connector pin 92 is also pushed inwardly or proximally to open a fluid flow path between the male and female connector pins 70, 92.

It will be apparent that when the plug 30 and socket 20 are separated, the male and female connector pins 70, 92 separate and their needle valves 96, 98 snap shut under their distal bias to close the throat and the distal end opening. This prevents leakage of hydraulic fluid from, or admission of sea water into, the related fluid circuits 88 of the skid 12 and the tool 26.

FIGS. 14 and 15 also show how the plug 30 and socket 20 couple with, and decouple from, each other. It will be seen that a sliding collar 102 of the socket 20 comprises concentric inner and outer walls 104, 106 that are spaced apart to define a circular, proximally-facing groove that accommodates the distal edge of a tubular wall 108 of the socket 20. The skirt 60 of the plug 30 is a sliding fit inside the inner wall 104 of the collar 102.

The collar 102 is biased distally by a coil spring 110 within the housing 74 that encircles the female cavity 72 of the socket 20 and surrounds the male connector pins 92. The spring 110 acts in compression between a proximal internal shoulder 112 of the collar 102 and the body 78 of the socket 20 at the base of the female cavity 72. Hydraulic pressure applied through a port 114 in the outer wall 106 of the collar 102 acts in the annulus between the outer wall 106 and the tubular wall 108 of the housing 74 to move the collar 102 proximally relative to the housing 74 against the bias of the spring 110.

The collar 102 and the housing 74 cooperate as a main actuator to which a control system of the skid 12 applies hydraulic pressure to lock the plug 30 into the socket 20 by retracting the collar 102 relative to the housing 74. Conversely, a fall in hydraulic pressure, whether deliberate or accidental, allows the spring 110 to push the collar 102 distally relative to the housing 74 to unlock the plug 30.

The collar 102 has a frusto-conical surround 116 between its inner and outer walls 104, 106 to guide the skirt 60 of the plug 30 into the female cavity 72 of the socket 20 upon insertion. A complementary frusto-conical surface 118 of the plug 30 cooperates with the frusto-conical surround 116 of the collar 102 upon insertion to seat the plug 30 inside the collar 102. At this stage, a circumferential outwardly-facing groove 120 around the skirt 60 of the plug 30 aligns with a circumferential locking ring 122 around the inner wall 104 of the collar 102.

The locking ring 122 comprises a circumferential array of steel locking balls 124 each retained in a respective bore 126 extending through the inner wall 104 of the collar 102. The balls 124 of the locking ring 122 are wider than the thickness of the inner wall 104 and must therefore protrude from the inner wall 104 either inwardly or outwardly in a radial direction with respect to the central longitudinal axis 94.

When the collar 102 is in a distal position under the bias of the spring 110 when hydraulic pressure between the collar 102 and the housing 74 is low, the locking ring 122 aligns with an inwardly-facing groove 128 around the tubular wall 108 of the socket 20. This inwardly-facing groove 128 accommodates outward protrusion of the balls 124 of the locking ring 122 and so allows the balls 124 to adopt a radially-outward position with respect to the inner wall 104 of the collar 102. This allows the skirt 60 of the plug 30 to be received as a close sliding fit inside the inner wall 104 of the collar 102 of the socket 20.

Up to this point, the ROV 10 simply places the plug 30 into the socket 20 to align the connector pins 70 in the plug 30 with their counterparts in the socket 20. Angular alignment between the pairs of connector pins 70, 92 is assured by aligning a key 130 on the plug 30, visible in FIG. 13, with a keyway 132 on the collar 102 of the socket 20, visible in FIG. 12. The ROV 10 inserts the plug 30 into the socket 20 to the extent necessary to align the groove 120 around the skirt 60 of the plug 30 with the locking ring 122 around the inner wall 104 of the collar 102. The next step is to lock the plug 30 into the socket 20 and to engage the aligned connector pins 70, 92 to open fluid flow paths through them, which is achieved by applying hydraulic pressure to the main actuator defined by the collar 102 and the housing 74.

Specifically, proximal movement of the collar 102 under hydraulic pressure between the collar 102 and the housing 74 against the bias of the spring 110 forces the locking ring 122 out of alignment with the inwardly-facing groove 128 around the housing 74 of the socket 20. In consequence, the balls 124 of the locking ring 122 are forced radially inwardly, where they engage with the outwardly-facing groove 120 around the skirt 60 of the plug 30 to lock the plug 30 to the collar 102 of the socket 20. Continued proximal movement of the collar 102 draws the plug 30 proximally with the collar 102 until the male and female connector pins 70, 92 engage with their counterparts as explained above to open fluid flow paths through them.

The plug 30 is held in the socket 20 by hydraulic pressure against the bias of the spring 110 such that deliberate release of hydraulic pressure effects disconnection; similarly, loss of hydraulic pressure effects emergency disconnection as a failsafe. In those circumstances, distal movement of the collar 102 under the bias of the spring 110 brings the locking ring 122 back into alignment with the inwardly-facing groove 128 around the housing 74 of the socket 20. Consequently, the balls 124 of the locking ring 122 are allowed to move radially outwardly into the groove 128 to disengage from the outwardly-facing groove 120 around the skirt 60 of the plug 30. This frees the plug 30 from the collar 102 of the socket 20.

In accordance with the invention, the plug body 56 also contains check valves 134 acting between the fluid flow paths of the plug 30 and a tool pressure compensator 136 shown schematically in FIGS. 14 and 15. Sealing elements 138 of the check valves 134 are movable by pressure difference across the valves to seal against valve seats 140 to close the valves 134 and are movable away from the valve seats 140 to open the valves 134 with reducing pressure difference across the valves 134.

When the plug 30 is not coupled to the socket 20, the check valves 134 are open because there is no differential pressure to close them so that the tool pressure compensator 136 acts on the hydraulic service lines 82 and the remainder of the circuits incorporating the tool drive 84.

When the plug 30 and the socket 20 are coupled together with the main actuator energised and the locking ring 122 locked, the check valves 134 can initially remain open if there is insufficient differential pressure to close them. However, the check valves 134 close when the tool operating pressure is selected and supplied through the socket 20, as this high pressure is sufficient to keep the sealing elements 138 forced against the valve seats 140. Then, the tool pressure compensator 136 no longer acts on the circuits incorporating the tool drive 84. Instead, the circuits incorporating the tool drive 84 are coupled to the circuits in the skid 12 and are thereby pressure-compensated by the vehicle pressure compensator 90, which may be mounted on the skid 12, on the socket 20 that is attached to the skid 12 or on another convenient structure such as the ROV 10 itself.

The safety pressure relief valve 62 also visible in FIG. 11 is connected to the tool compensation circuit including the tool pressure compensator 136 to protect that circuit from over-pressure in the event of a check valve 134 failing to seat.

FIGS. 14 and 15 also show an optional emergency eject mechanism 142 that, on disconnection, promotes complete disposal of the plug 30 from the socket 20. This allows clear recovery of the ROV 10 in an emergency, for example if the tool 26 associated with the plug 30 becomes irretrievably snagged.

The emergency eject mechanism 142 shown in FIGS. 14 and 15 comprises a hollow spring-loaded spear 144 on the central longitudinal axis 94 of the housing 74 that is biased distally with respect to the housing 74 by a coil spring 146 inside the spear 144. The spear 144 is telescopic: it comprises a movable distal part 148 that has a closed distal end and an open proximal end, received in a fixed proximal part 150 that has an open distal end and a closed proximal end. The spring 146 acts in compression between the closed distal and proximal ends.

The distal part projects distally from the base of the housing 74 of the socket 20 between the surrounding male connector pins 92. The proximal part 150 is fixed to, and projects proximally from, the base 78 of the housing 74 to accommodate proximal movement of the distal part 148 against the bias of the spring 146.

Hydraulic pressure applied through a port 152 in the fixed proximal part 150 of the spear 144 acts in the annulus between the distal part 148 and the proximal part 150 of the spear 144 to move the distal part 148 proximally relative to the proximal part 150 against the bias of the spring 146. Thus, the distal and proximal parts 148, 150 cooperate as an ejector actuator to which the control system of the skid 12 applies hydraulic pressure to retract the distal part 148 of the spear 144 before insertion of the plug 30 into the socket 20.

The distal part 148 of the spear 144 is held retracted at all times when the plug 30 and socket 20 are connected, for as long as sufficient hydraulic pressure is applied to the ejector actuator. In the event of complete pressure loss in both the main actuator and the ejector actuator, the distal part 148 of the spear 144 acts against the plug 30 to push it clear of the socket 20 when the balls 124 of the locking ring 122 have disengaged from the groove 128 to disengage the plug 30 from the socket 20. Specifically, the load in the spring 146 forces the distal part 148 of the spear 144 against a plate 154 on the central longitudinal axis 94 of the plug 30 between the female connector pins 70. So, when the emergency eject mechanism 142 is fitted, a complete loss of hydraulic pressure does not merely disconnect the plug 30 from the socket 20: it also pushes the plug 30 clear of the socket 20 so that the ROV 10 can, if necessary, drop the tool 26 and move away.

The invention is not restricted to use with a skid 12. For example, different mechanical arrangements are possible for mounting and powering the connection. Other options may include mounting the system directly to an ROV 10 or to another underwater vehicle of any type. Tools 26 may also be deployed by means other than a basket 24.

Many other variations are possible without departing from the inventive concept. For example, pressure compensation may be applied to the tools 26 collectively via a shared pressure compensation system on the basket 24, to which the tools 26 may be coupled via their plugs 30.

The invention claimed is:

1. A hydraulically-powered tool system for subsea interventions, the system comprising:

a tool communicating with a first connector element, the tool and the first connector element being on a hydraulic drive circuit; and a tool power unit having a hydraulic supply circuit communicating with a second connector element, the first and second connector elements being arranged to be wet-mated with each other to establish fluid communication between the supply circuit and the drive circuit for powering movement of one or more elements of the tool when in use;

wherein:

the drive circuit is pressure-compensated by a drive circuit compensator, minimizing a pressure difference between the drive circuit and a hydrostatic pressure of surrounding environment;

the supply circuit is pressure-compensated by a supply circuit compensator, minimizing a pressure difference between the supply circuit and a hydrostatic pressure of surrounding seawater; and the system further comprises at least one valve that, when the drive circuit and the supply circuit are in fluid communication, is operable to transfer pressure compensation of one of said circuits from the compensator of that circuit to the compensator of the other circuit.

2. The system of claim 1, wherein the or each valve is operable to transfer pressure compensation of the drive circuit from the drive circuit compensator to the supply circuit compensator.

3. The system of claim 2, wherein the or each valve is operable to isolate the drive circuit compensator from the drive circuit.

4. The system of claim 3, wherein the or each valve is disposed between the drive circuit compensator and the drive circuit so as, when open, to connect the drive circuit compensator to the drive circuit and, when closed, to isolate the drive circuit compensator from the drive circuit.

5. The system of claim 2, wherein the or each valve is operable to transfer pressure compensation of the drive circuit to the supply circuit compensator in response to increasing pressure in the supply circuit.

6. The system of claim 5, wherein the or each valve comprises a movable valve element disposed between the supply circuit and a valve seat, to be forced by overpressure in the supply circuit against the valve seat to close the or each valve.

7. The system of claim 2, wherein the or each valve is integral with the first connector element.

8. The system of claim 2, further comprising a pressure-relief valve communicating with the drive circuit compensator, wherein the or each valve that is operable to transfer pressure compensation is disposed between the pressure-relief valve and the supply circuit.

9. The system of claim 1 and comprising a flexible hose coupling the tool to the first connector element.

10. The system of claim 1, wherein the first connector element is integrated with or rigidly attached to the tool.

11. The system of claim 1, further comprising a locking system that is powered for locking the first and second connector elements in fluid communication and that is biased to unlock the first and second connector elements on loss of power.

12. The system of claim 1, further comprising an ejection system that is powered to allow the first and second connector elements to be brought into fluid communication and that is biased to force apart the first and second connector elements on loss of power.

13. The system of claim 1, wherein the tool power unit is positioned in an underwater vehicle or in a power module attached to an underwater vehicle.

14. The system of claim 13, wherein the tool is arranged to be supported by the underwater vehicle in which the tool power unit is positioned or to which the power module is attached.

15. A method of pressure compensation when using a hydraulically-powered tool system for subsea interventions, the method comprising:

wet-mating connector elements to establish fluid communication between a pressure-compensated hydraulic supply circuit and a pressure-compensated hydraulic drive circuit of a tool; and transferring pressure compensation of a first of said supply and drive circuits to a compensator acting on a second of said supply and drive circuits, minimizing a pressure difference between the supply and drive circuits and a hydrostatic pressure of surrounding seawater.

16. The method of claim 15, comprising isolating the first circuit from a compensator acting on the first circuit.

17. The method of claim 15, comprising transferring pressure compensation of the drive circuit to a compensator acting on the supply circuit.

18. The method of claim 17, comprising transferring pressure compensation of the drive circuit in response to increasing pressure in the supply circuit.

19. The method of claim 18, comprising wet-mating the connector elements before increasing pressure in the supply circuit to a tool drive pressure.

20. A connector element for a hydraulically-powered subsea tool system, wherein:

the element communicates with a hydraulic drive or supply circuit that is pressure-compensated by a compensator, minimizing a pressure difference between the circuit and a hydrostatic pressure of surrounding seawater; and the element comprises at least one first valve for opening and closing a fluid flow path through at least one port between the connector element and a hydraulically-powered subsea tool, and at least one second valve that is operable to transfer pressure compensation of the circuit from that compensator to a compensator of another circuit to which the connector is wet-mated in use.

21. A combination of connector elements for a hydraulically-powered subsea tool system, at least one of those elements being as defined in claim 20, wherein:

a first connector element is on a hydraulic drive circuit;

a second connector element is on a hydraulic supply circuit for supplying hydraulic fluid to the drive circuit when the connector elements are wet-mated in use;

the drive circuit is pressure-compensated by a drive circuit compensator;

the supply circuit is pressure-compensated by a supply circuit compensator; and one or more of the at least one second valve is operable to transfer pressure compensation of one of said circuits from the compensator of that circuit to the compensator of the other circuit.

* * * * *